US009728828B2

(12) United States Patent
Privett

(10) Patent No.: US 9,728,828 B2
(45) Date of Patent: Aug. 8, 2017

(54) WAVEGUIDE ASSEMBLY FOR COUPLING A WAVEGUIDE TO AN APPARATUS USING A WAVEGUIDE ADAPTER ASSEMBLY

(75) Inventor: Jason B. Privett, Devon (GB)

(73) Assignee: Flexiguide Ltd. (GB)

( * ) Notice: Subject to any disclaimer, the term of this patent is extended or adjusted under 35 U.S.C. 154(b) by 0 days.

(21) Appl. No.: 14/401,260

(22) PCT Filed: May 16, 2012

(86) PCT No.: PCT/GB2012/000437

§ 371 (c)(1),
(2), (4) Date: Nov. 14, 2014

(87) PCT Pub. No.: WO2013/171438

PCT Pub. Date: Nov. 21, 2013

(65) Prior Publication Data

US 2015/0207192 A1 Jul. 23, 2015

(51) Int. Cl.
*H01P 1/04* (2006.01)

(52) U.S. Cl.
CPC ..... *H01P 1/042* (2013.01)

(58) Field of Classification Search
CPC ..... H01P 1/042; H01P 11/02; H01P 11/002
USPC ..... 333/254, 255; 29/600
See application file for complete search history.

(56) References Cited

U.S. PATENT DOCUMENTS 3,374,450 A * 3/1968 Stewart ..... H01P 1/042 285/253
3,500,264 A * 3/1970 Floyd, Jr. ..... H01P 1/042 285/363
7,420,443 B2 * 9/2008 Paynter ..... H01P 1/042 333/254

FOREIGN PATENT DOCUMENTS

| | | | |
|---|---|---|---|
| EP | 1104042 | A2 | 5/2001 |
| FR | 2649280 | A1 | 1/1991 |
| GB | 865591 | A | 4/1961 |
| JP | 9312501 | A | 12/1997 |
| WO | 2011033639 | A1 | 3/2011 |

OTHER PUBLICATIONS

International Search Report, PCT Application No. PCT/GB2012/000437, issued Nov. 21, 2013, 3 pages.

(Continued)

*Primary Examiner* — Benny Lee
(74) *Attorney, Agent, or Firm* — Arnold, Knobloch & Saunders, LLP; Jason Saunders

(57) ABSTRACT

A waveguide adapter assembly for coupling a waveguide to an apparatus comprises a waveguide adapter having an adapter body, having a first end, a second end and a cavity therein. The cavity has a first opening in the first end for receiving an end portion of a waveguide and a second opening in the second end for communicating with a corresponding opening in the apparatus. The second end has a face around the second opening for mating with a corresponding surface of the apparatus. A flange assembly has a first end and a second end for connecting to the apparatus, with a bore therethrough for receiving the waveguide adaptor. In a further arrangement, the adapter assembly comprises an adapter body for receiving an end portion of a waveguide and for connecting to the apparatus; and means for biasing the adapter body into contact with a mating surface of the apparatus.

18 Claims, 6 Drawing Sheets

(56) References Cited

OTHER PUBLICATIONS

Written Opinion of the International Searching Authority, PCT Application No. PCT/GB2012/000437, issued Nov. 21, 2013, 6 pages.

* cited by examiner

WAVEGUIDE ASSEMBLY FOR COUPLING A WAVEGUIDE TO AN APPARATUS USING A WAVEGUIDE ADAPTER ASSEMBLY

FIELD

The present invention relates generally to a waveguide assembly. The invention relates in particular to a waveguide adaptor assembly for mating a waveguide to an instrument or apparatus and to a waveguide assembly. The invention further relates to a method for connecting a waveguide to a desired interface, for example a flange.

BACKGROUND

Waveguides are commonly used for transmitting electromagnetic wave energy from one point to another and are known in the art. A common use for waveguides is in the transmission of electromagnetic signals between an antenna and transmitting or receiving equipment. Waveguides are also used more generally in the connecting together of transmitting and receiving equipment. The present invention relates to a waveguide adaptor assembly and to a waveguide assembly for connecting waveguides. It will be appreciated that there are many further uses of waveguides falling within the scope of the invention.

A waveguide typically comprises a transmission line formed from a hollow conducting tube providing a conduit through which electromagnetic waves are propagated. The tube is typically of constant cross-section throughout the length of propagation and may be of a flexible or rigid type. Common cross-sectional shapes for the conduits of such waveguides include, for example, square, rectangular, circular, or elliptical.

As noted above, it is generally necessary for waveguides to be coupled or connected to transmitting or receiving equipment, or an antenna. To this end, waveguides are commonly fitted with a coupling system for use therewith. It is widely known that both the design of the waveguide and the coupling system are critical to the overall performance of the assembly. In order to reduce reflection losses and impedance mismatches, waveguides are often mounted to an interface, such as a waveguide flange connector.

Specifications for standard interfaces, such as waveguide flange connectors, vary from one application to another, and are largely determined by each manufacturer's transmitting or receiving equipment requirements. On the other hand, waveguides themselves are typically of standard dimensions, sizes of which are well-known in the art.

Many flange connectors incorporate a gasket between the mating face of the flange and the apparatus or equipment to which the waveguide is being connected. To prevent the ingress of water, in particular for assemblies intended for outdoor applications, a sealing groove may be provided in the flange surface, such that a gasket may be seated in the groove.

A common method of connecting a waveguide to an interface, such as a waveguide flange connector, involves the use of molten solder to form a joint between the waveguide and the connector. Solder between the waveguide and flange connector creates an electrically uniform and secure connection and allows for waveguide flange connectors to be pre-installed on the waveguide before the complete waveguide assembly is shipped, ready for use.

An alternative manner of connecting a waveguide is disclosed in US 2005/0285702. The method comprises fitting a flange adapter to the end of a waveguide, such that it is securely fastened. An interface is provided, the interface having a retaining groove, a side of which is to integrate with the flange adapter. During construction, the flange adapter comprising the waveguide is inserted into the interface retaining groove, and a retainer inserted, which biases the interface end of the flange adapter against the interface, thus clamping together the respective parts.

An alternative approach to the above is provided in US 2003/0137465. The method again comprises the use of a flange adapter for coupling to a waveguide. An interface is provided, the interface having a semi-permanent coupling means. The flange adapter is secured to the coupling means by a bolted arrangement, thus allowing multiple interfaces to be interchanged between the same waveguide.

Similar approaches for connecting waveguides to that disclosed in US 2003/0137465 are disclosed in GB 1,135,258 and GB 1,131,826. GB 1,135,258 discloses a method of attaching a waveguide to a flange. In this case, there is provided a flange and coupling assembly comprising a clamping arrangement including a flange member and a clamping member, both of which have a rectangular opening therethrough. A waveguide is first inserted through the clamping member so as to extend through fully in an opposing direction to the flange member. Four clamping surfaces are formed by deforming the side walls of the waveguide, and the clamping member brought into contact with the flange. A bolted arrangement securely fastens the two sections together.

GB 1,131,826 discloses another method for securing a waveguide to a flange. A coupling arrangement is provided for connecting together two tubular members on a common axis. Both the waveguide and flange are provided with locking means, including a rigid lug and a deformable lug, and arranged such that the deformable lug is able to be bent around the rigid lug, so as to lock the waveguide to the flange.

Yet a further alternative approach is disclosed in US 2007/0262837. The document is concerned with providing a waveguide with a waveguide interface, the waveguide interface comprising a split ring with a first half and a second half joined by a web portion. Both portions of the split ring are configured to mate with the waveguide, which, during assembly, are provided to clamp the exterior of the waveguide and communicate with an overbody. The overbody is drawn against the split ring, which seats the split ring within the overbody. The overbody comprising the split ring and waveguide are then secured to an interface element by way of bolted fasteners. The complete assembly may then be aligned and fitted to engage any number of corresponding interfaces.

A particular issue arising with connector assemblies for waveguides is the occurrence of corrosion, in particular galvanic corrosion arising at the joint between two dissimilar metals. Techniques are known in the art for reducing galvanic corrosion. For example, it is known to coat the mating faces of the parts of the joint with a layer of a metal, in particular silver or tin. However, this measure is costly and time consuming.

There is a need for an improved assembly for coupling a waveguide to an apparatus or item of equipment. It would be advantageous if the assembly could be inexpensive to manufacture. It would be further advantageous if the assembly could reduce or prevent the occurrence of corrosion, in particular galvanic corrosion, as occurs with known devices.

SUMMARY OF THE INVENTION

An assembly for coupling a waveguide to an apparatus has now been found which relies on the assembly of an adapter body and a flange assembly and a mechanical connection provided therebetween. The assembly allows the flange assembly to be formed separate to the adapter body and of a non-conductive material, thereby preventing galvanic corrosion from occurring.

According to the present invention, there is provided a waveguide adapter assembly for coupling a waveguide to an apparatus, the assembly comprising:

a waveguide adapter having an adapter body, the adapter body having a first end and a second end, the adapter body further having a cavity therein, the cavity having a first opening in the first end for receiving an end portion of a waveguide and a second opening in the second end for communicating with a corresponding opening in the apparatus, the second end having a mating face around the second opening for mating with a corresponding surface of the apparatus; and a flange assembly having a first end, and a second end for connecting to the apparatus, the flange assembly having a bore therethrough for receiving the waveguide adaptor.

The present invention provides for a waveguide adapter assembly for coupling a waveguide to an apparatus, for example an antenna, transmitting or receiving equipment, and the like. The arrangement of the assembly of the present invention provides the advantage that galvanic corrosion between the components of the assembly, in particular of the waveguide, may be reduced or eliminated without the need for coating the component mating surfaces, as is required with known assemblies.

As indicated above, the present invention provides for a waveguide adapter assembly, the waveguide adapter assembly comprising a waveguide adapter. In use, the waveguide adapter is provided as an intermediate connection between the waveguide and the apparatus or equipment to which the waveguide is being connected.

As noted above, the present invention comprises a waveguide adapter, the waveguide adapter comprising an adapter body, the adapter body having a first end and a second end. References herein to the first end are references to the distal end of the adapter body, that is the end positioned furthest away from the apparatus, when the waveguide assembly is installed and in use. It follows that references herein to the second end are with respect to the proximal end of the adapter body, that is the end positioned adjacent the apparatus, when the waveguide assembly is installed and in use. In use, the first end of the adapter body faces the waveguide, as described in more detail hereinbelow. The second end of the adapter body is secured to the apparatus, as also described in more detail below.

The adapter body comprises a cavity therein, the cavity having a first opening in the first end for receiving an end portion of a waveguide. The first opening in the first end of the adapter body may be of any suitable shape for receiving an end portion of a waveguide. In general, the shape of the first opening will be determined by the cross-sectional shape of the waveguide being connected. Examples of shapes for the first opening in the first end of the adapter body are rectangular, square, elliptical and circular.

The cavity further comprises a second opening in the second end for communicating with a corresponding opening in the apparatus to which the waveguide is being connected. The second opening in the second end may be of any suitable shape and size for communicating with a corresponding opening in the apparatus. In many cases, the shape of the second opening will be determined by the cross-sectional shape of the corresponding opening in the apparatus to which the waveguide is being connected. Examples of shapes for the second opening in the second end of the adapter body are rectangular, square, elliptical and circular.

The shape of the first opening in the first end of the adapter body may be the same as the shape of the second opening in the second end of adapter body. Alternatively, the first and second openings may be different in shape. In one embodiment, the first and second openings are of the same shape. In such embodiments, the cavity in the adapter body extending between the first and second openings is substantially uniform in cross-sectional shape along its length between the first and second openings.

As noted above, in use, the cavity of the adapter body receives the end portion of a waveguide extending into the cavity through the first opening in the first end of the adapter body. The waveguide may extend into the cavity of the adapter body any suitable distance to allow the adapter body to be secured to the end portion of the waveguide.

The cavity in the adapter body may have any suitable cross-section. For example, the cavity may be constant in cross-sectional area along its length or a substantial portion of its length. Alternatively, the cavity may have a cross-section that changes along its length, for example being tapered. In one preferred arrangement, the adapter body is provided with one or more shoulders within the cavity against which the end of the waveguide can abut. The at least one shoulder may be formed by a respective protrusion extending into the cavity. Alternatively, the at least one shoulder may be provided by the portion of the cavity receiving the waveguide having an increased cross-sectional area relative to the remainder of the cavity. Preferably, the shoulder is an annular shoulder extending around the wall of the cavity.

In one preferred embodiment, the second end of the adapter body is provided with one or more projections that extend from the second opening into the cavity for contacting the end of the waveguide. In a preferred arrangement, the second end is provided with a single projection extending fully around the circumference of the second opening in the second end of the adapter body in the form of an inwardly extending flange. Preferably, the one or more projections at the second end of the adapter body, in particular the inwardly extending flange, is arranged to be flush with the mating surface of the second end of the adapter body.

The mating face of the second end of the adapter body is for mating with a corresponding surface of the apparatus. In particular, in use, the adapter assembly is secured to the apparatus such that the mating face of the second end of the adapter body contacts the corresponding face of the apparatus, thereby providing a conduit connecting the waveguide with the opening in the apparatus. The mating face of the second end of the adapter body may be of any suitable shape, size or profile for mating with a corresponding surface of the apparatus. It is preferred that the mating face is a flat, smooth surface aligned perpendicular to the longitudinal axis of the waveguide and the adapter body so as to form an electrically conductive contact and seal with the corresponding surface of the apparatus. Such a seal is necessary and advantageous in preventing power leakage between the mating face around the second opening at the second end and the corresponding surface of the apparatus.

The adapter body may be of any suitable material. The adapter body is most preferably formed from an electrically conductive material, such as a metal or a metal alloy. Alternatively, the adapter body may be formed from a material that is electrically non-conductive, such as a polymer, and the body coated in an electrically conductive material, such as a metal or metal alloy. If the adapter body is provided with an electrically conductive coating, it is preferably applied at least to the inner surfaces of the cavity and to the faces at the first and second ends of the adapter body, thereby forming an electrically conductive path between the end of the waveguide and the mating face of the apparatus to which the second end of the adapter body is secured.

Suitable materials for forming the adapter body or the coating thereon include metals, such as aluminium and copper, and alloys, such as brass.

Any suitable manufacturing method may be used for forming the adapter body, for example molding, milling and the like. One exemplary process is that of stamping, thus forming the adapter body from sheet material.

As noted, the waveguide adapter assembly of the present invention further comprises a flange assembly, the flange assembly having a first end and a second end. References herein to the first end are with respect to the distal end of the flange assembly, that is the end positioned furthest away from the apparatus, when the waveguide assembly is installed and in use. It follows that references herein to the second end are with respect to the proximal end of the flange assembly, that is the end adjacent the apparatus, when the waveguide assembly is installed and in use.

The flange assembly provides the means by which the adapter assembly is connected to the apparatus when in use. As noted, the flange assembly has a first end. In use, the first end faces the waveguide. The flange assembly also has a second end for connecting to the apparatus. The flange assembly further comprises a bore extending between the first end and the second end, for receiving the waveguide adapter.

The flange assembly may be of any suitable material for receiving the waveguide adapter and for connecting to the apparatus. By having the flange assembly a separate component to the adapter body, the flange assembly may be formed from a different material to that of the adapter body. In particular, the flange assembly may be formed from a material that is electrically non-conductive, thereby preventing galvanic corrosion of the flange assembly and the components to which it is mated occurring. Any suitable non-conductive material may be used to form the flange assembly. The flange assembly is preferably of plastic. Suitable plastics include polyolefins, such as polyethylene and polypropylene, and polyamides.

The flange assembly may be formed by any suitable technique, such as molding or milling. It is preferred that the flange assembly is formed from a material that may be molded.

As described, the flange assembly has a bore for receiving the waveguide adapter. In use, the waveguide is secured at its end portion to the waveguide adapter, which in turn is held by the flange assembly so as to mate with the appropriate opening and surface of the apparatus.

In one embodiment, the adapter body is moveable within the bore of the flange assembly. More preferably, the adapter body is moveable within the bore of the flange assembly and is provided with means to bias the second end of the adapter body in the direction from the first end to the second end of the flange assembly, as discussed in more detail below.

In one embodiment, the waveguide adapter extends through the flange assembly, from the first end to the second end of the flange assembly. To retain the adapter body within the bore, the first end of the adapter body may be provided with one or more projections extending laterally outwards therefrom to engage with the first end of the flange assembly. In one preferred embodiment, the first end of the adapter body is provided with a flange extending outwards from the first end to contact the flange assembly. In this way, movement of the adapter body within the bore of the flange assembly in the direction from the first end to the second end is limited.

In an alternative arrangement, the waveguide adapter extends only partially through the bore in the flange assembly. In this alternative arrangement, it is particularly preferred that the waveguide adapter extends in the bore in the flange assembly from the second end of the flange assembly, towards the first end of the flange assembly. The bore of the flange assembly is preferably provided with a shoulder formed by one or more protrusions against which the adapter body abuts when located in the bore. In one embodiment, the portion of the bore of the flange assembly extending from the first end is provided with an increased cross-sectional area to receive the adapter body. The portion of the bore of increased cross-sectional area may be any suitable length to accommodate the adapter body, preferably from 0.5 mm to 20.0 mm, more preferably from 1.0 to 15.0 mm, still more preferably from 2.0 to 10.0 mm.

As noted, in use, the second end of the adapter body contacts the corresponding surface of the apparatus to which the waveguide is being connected. The flange assembly is mounted to the apparatus such that its second end is towards the apparatus. The waveguide adapter body may, in one embodiment, have the face at its second end aligned with the second end of the flange assembly, to fit flush when communicating with the apparatus. In a more preferred arrangement, the waveguide adapter is arranged within the bore of the flange assembly such that the second end of the adapter body extends beyond the second end of the flange assembly. The second end of the waveguide adapter body may extend beyond the second end of the flange assembly by any distance to ensure a close contact is achieved between the second end of the adapter body and the corresponding surface of the apparatus. Preferably, the second end of the waveguide adapter body extends beyond the second end of the flange assembly in the range of from 0.005 mm to 5 mm, more preferably in the range of from 0.01 mm to 4 mm, even more preferably in the range of from 0.05 mm to 2 mm. Contact between the second end of the adapter body and the corresponding surface of the apparatus is preferably further enhanced by providing means to bias the second end of the adapter body away from the second end of the flange assembly towards the apparatus, as noted above and discussed in more detail below.

The flange assembly may be connected to the apparatus in any suitable manner, as is known in the art. For example, the flange assembly may be connected by means of one or more bolts, screws or the like.

In one preferred embodiment, the flange assembly comprises a flange assembly body extending from the first to the second end of the flange assembly and having the bore extending therethrough. A flange extends outwards from the flange body at the second end of the flange assembly. The assembly is mounted to the apparatus by the means of the flange, for example by one or more bolts or screws extending through corresponding bores in the flange, as is known in the art. The flange may have any suitable shape, for example rectangular, square or circular.

The flange assembly or a portion thereof, for example the flange thereof, may be formed to be elastically deformable, such that the action of mounting the flange assembly to the apparatus urges the second end of the adapter body into contact with the corresponding surface of the apparatus.

A gasket may be provided between the flange assembly and the apparatus, as is known in the art. In general, a gasket is provided for outdoor applications, in particular to prevent the ingress of water, and/or when the waveguide contains a pressurised gas.

In use, the waveguide is connected at its end portion to the adapter body. Any suitable means may be used to connect the waveguide to the adapter body. A preferred technique is to solder the waveguide to the adapter body. As noted the adapter body is received within the bore of the flange assembly. Any suitable means may be used to secure the adapter body in the bore and to the flange assembly. In one preferred arrangement, the waveguide adapter assembly is assembled by having a flexible sleeve cast around the outer surface of the waveguide and a portion of the flange assembly. In this way, the flexible sleeve holds the flange assembly to the waveguide and, thereby holds the adapter body at the end portion of the waveguide within the bore of the flange assembly.

In one particular embodiment, the flexible sleeve biases the waveguide and the adapter body within the flange assembly in the direction from the first end to the second end. When in use, this biasing action urges the second end of the adapter body into contact with the corresponding mating surface of the apparatus, in turn helping to improve the contact and seal between the adapter body and the apparatus.

Suitable materials for forming the flexible sleeve are known in the art and include flexible polymers, such as elastomers and synthetic rubbers, for example silicone rubber and polychloroprene.

The flexible sleeve is secured to the outer surface of the waveguide by adhesion. Similarly, the flexible sleeve is adhered to the outer surface of the flange assembly. Preferably, the flange assembly is provided with means to form an interference connection with the cast sleeve, to improve the connection between the waveguide and the flange assembly.

In one preferred embodiment, the flange assembly comprises a protrusion extending from the first end of the flange assembly, with the flexible sleeve being formed over the protrusion at the first end of the flange assembly. The protrusion may be of any suitable form, shape or size. In one arrangement the protrusion comprises a number of discontinuous protrusion portions extending from the first end of the flange assembly. In an alternative arrangement the protrusion comprises a single continuous protrusion, for example in the form of a continuous ring extending from the first end of the flange assembly around the opening of the bore. The ring may be of any suitable shape or size. In a preferred form, the ring is generally cylindrical.

To provide an improved mechanical connection between the flange assembly and the flexible sleeve, the at least one protrusion may be provided with one or more recesses or openings therein, to thereby form an interference connection with the material of the flexible sleeve. To further improve the interference location of the components of the assembly the waveguide adapter may be provided with one or more openings therein to align with corresponding openings in the flange assembly and to receive material of the flexible sleeve, when formed around the flange assembly.

In a further aspect, the present invention provides a waveguide assembly, the assembly comprising a waveguide adapter assembly as hereinbefore described and a waveguide, an end portion of the waveguide being received within the cavity of the adapter body.

The waveguide assembly preferably has the end portion of the waveguide connected to the adapter body. The waveguide may be permanently attached to the adapter body, for example by soldering. Alternatively, the waveguide may be releasably attached thereto.

The waveguide assembly preferably further comprises a flexible sleeve formed, for example by casting, around the waveguide and a portion of the outer surface of the flange assembly, thereby connecting the waveguide and the flange assembly together. In one embodiment, the sleeve is cast around the assembly with the waveguide located in the adapter body and the adapter body located in the flange assembly.

In one preferred embodiment, the sleeve acts to bias the adapter body in the direction from the first end to the second end, as hereinbefore described.

As noted, it can be advantageous to bias the adapter body towards the apparatus, such that the second end of the adapter body is urged into contact with the corresponding surface of the apparatus.

Accordingly, in a further aspect, the present invention provides a waveguide adapter assembly for connecting a waveguide to an apparatus, the assembly comprising:

an adapter body for receiving an end portion of a waveguide and for connecting to the apparatus; and means for biasing the adapter body into contact with a mating surface of the apparatus.

Preferably, the adapter assembly comprises a flange assembly and an adapter as hereinbefore described.

In one embodiment, the biasing means for urging the adapter body into contact with the apparatus may be a flexible sleeve formed as described above. Alternatively, or in addition thereto, the adapter body may be formed to be inherently biased or sprung in the longitudinal direction of the waveguide. For example, the adapter body may be formed with a portion that is elastically deformable, so as to apply a biasing force to the second end of the adapter body urging it into contact with the corresponding surface of the apparatus. In one embodiment, the adapter body extends within the bore of the flange assembly from the second end of the flange assembly and is retained against a shoulder within the bore.

BRIEF DESCRIPTION OF THE DRAWINGS

Embodiments of the present invention will now be described, by way of example only, having reference to the accompanying drawings, in which.

DETAILED DESCRIPTION OF EXAMPLES OF THE EMBODIMENTS

Figure 1:
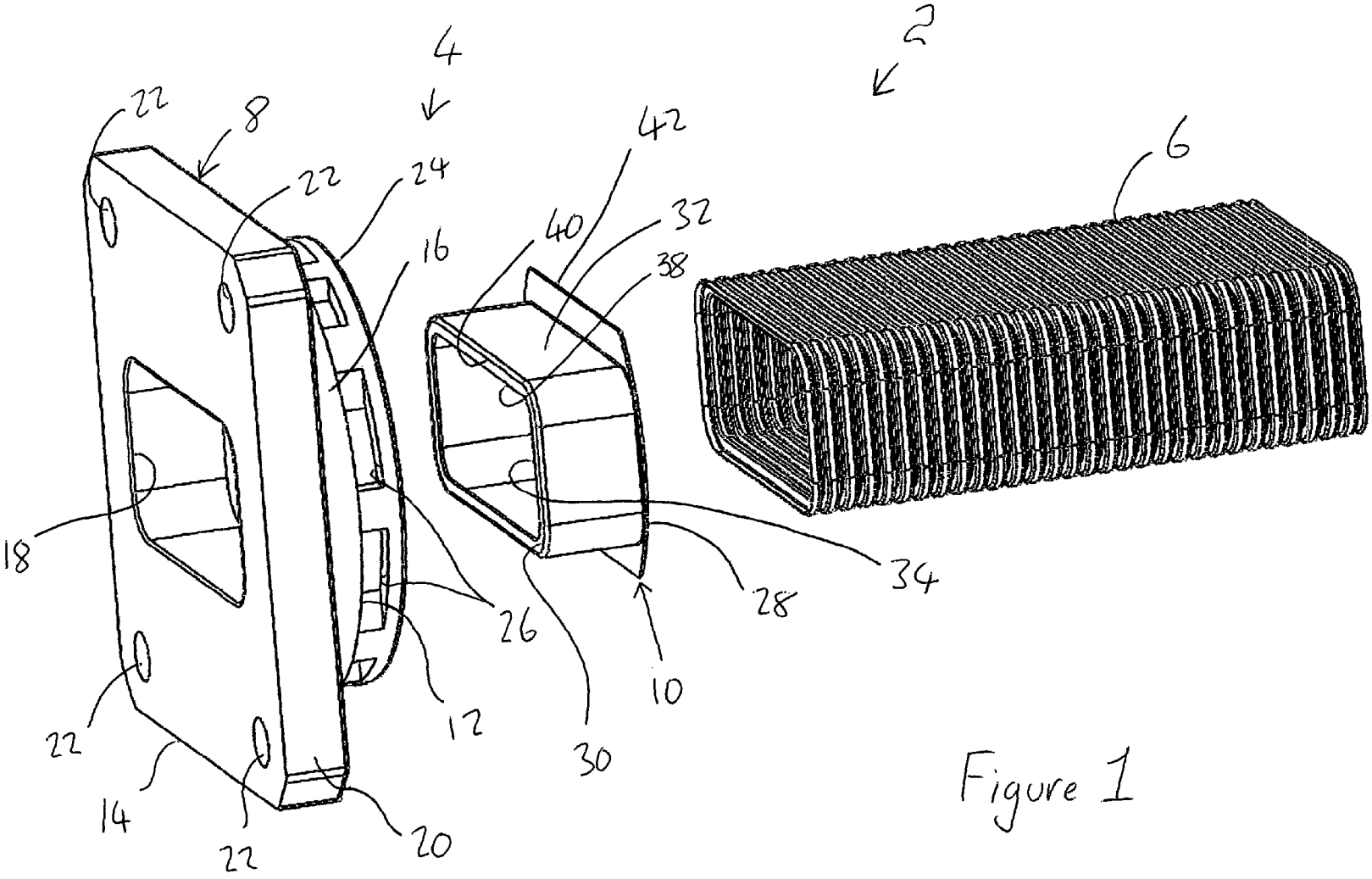
FIG. 1 is an exploded perspective view of a waveguide assembly comprising a waveguide adapter assembly according to one embodiment of the present invention.

Like features in different drawing figures are denoted by the same reference label and may not be described at every instance in the drawing figures.

Referring to FIG. 1, a waveguide assembly according to one embodiment of the present invention is shown, generally indicated as 2. The waveguide assembly 2 comprises a waveguide adapter assembly, generally indicated as 4, and a waveguide 6 of known configuration. The waveguide adapter assembly 4 comprises a flange assembly 8 and an adapter 10.

The flange assembly 8 has a first end 12 for receiving the waveguide 6 and a second end 14 for connecting with an apparatus. The flange assembly 8 is of a moulded plastic material, in particular NYLON (an aliphatic or semi-aromatic polyamide).

The flange assembly 8 comprises a flange body 16 having a generally rectangular bore 18 extending longitudinally therethrough. A generally rectangular flange 20 is provided at the second end 14 of the flange assembly. The flange 20 is provided with bores 22 therethrough for receiving bolts (not shown for clarity) for connecting the flange 20 to the apparatus.

A cylindrical ring 24 extends from flange body 16 at the first end 12 of the flange assembly and is provided with rectangular openings 26 therein.

Figure 2:
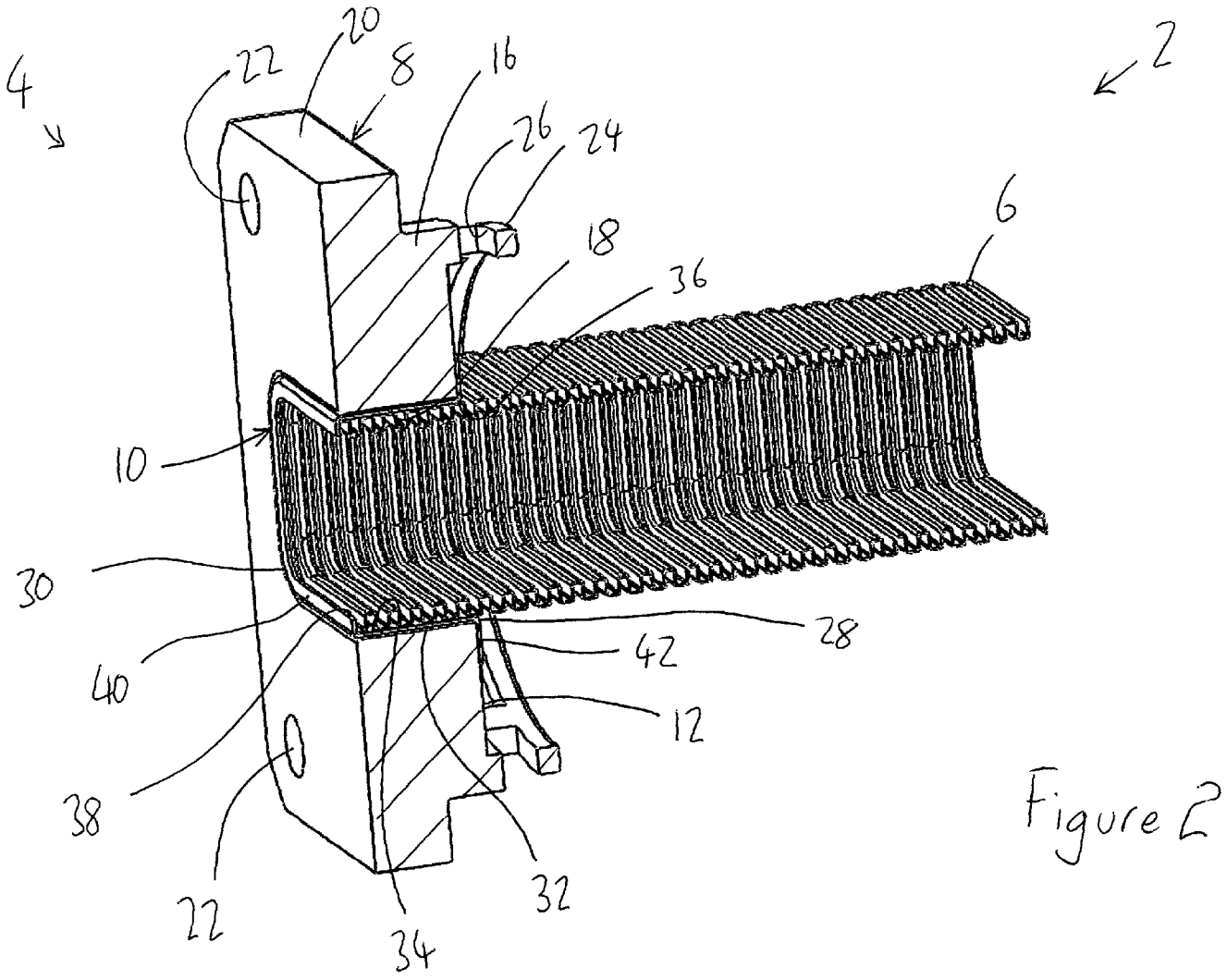
FIG. 2 is a cross-sectional view of the assembly of FIG. 1 in a first assembled condition.

Turning to the adapter 10, the adapter has a first end 28 and a second end 30. The adapter 10 further has an adapter body 32 having a cavity 34 therein having a first opening 36 in the first end 28, as shown in FIG. 2, and a second opening 38 in the second end 30, as shown in FIG. 2. The cavity 34 is generally rectangular in cross-section. A waveguide retaining flange 40 extends into the cavity within the adapter body from the second end 30. A flange 42 extends outwards from the adapter body 32 at the first end 28.

The adapter 10 is preferably formed from brass. Other suitable materials include aluminium, copper, and non-conductive materials, such as a polymer, coated in a layer of an electrically conductive material.

The components of the waveguide assembly 2 are assembled as shown in FIG. 2, that is with the end portion of the waveguide 6 extending through the first opening 36 and received within the cavity 34 of the adapter body 32. The end of the waveguide 6 is soldered to the waveguide retaining flange 40. The adapter 10 is received in the bore 18 in the body 16 of the flange assembly 8 with the flange 42 at the first end 28 of the adapter 10 against the first end 12 of the flange assembly 8.

Figure 3:
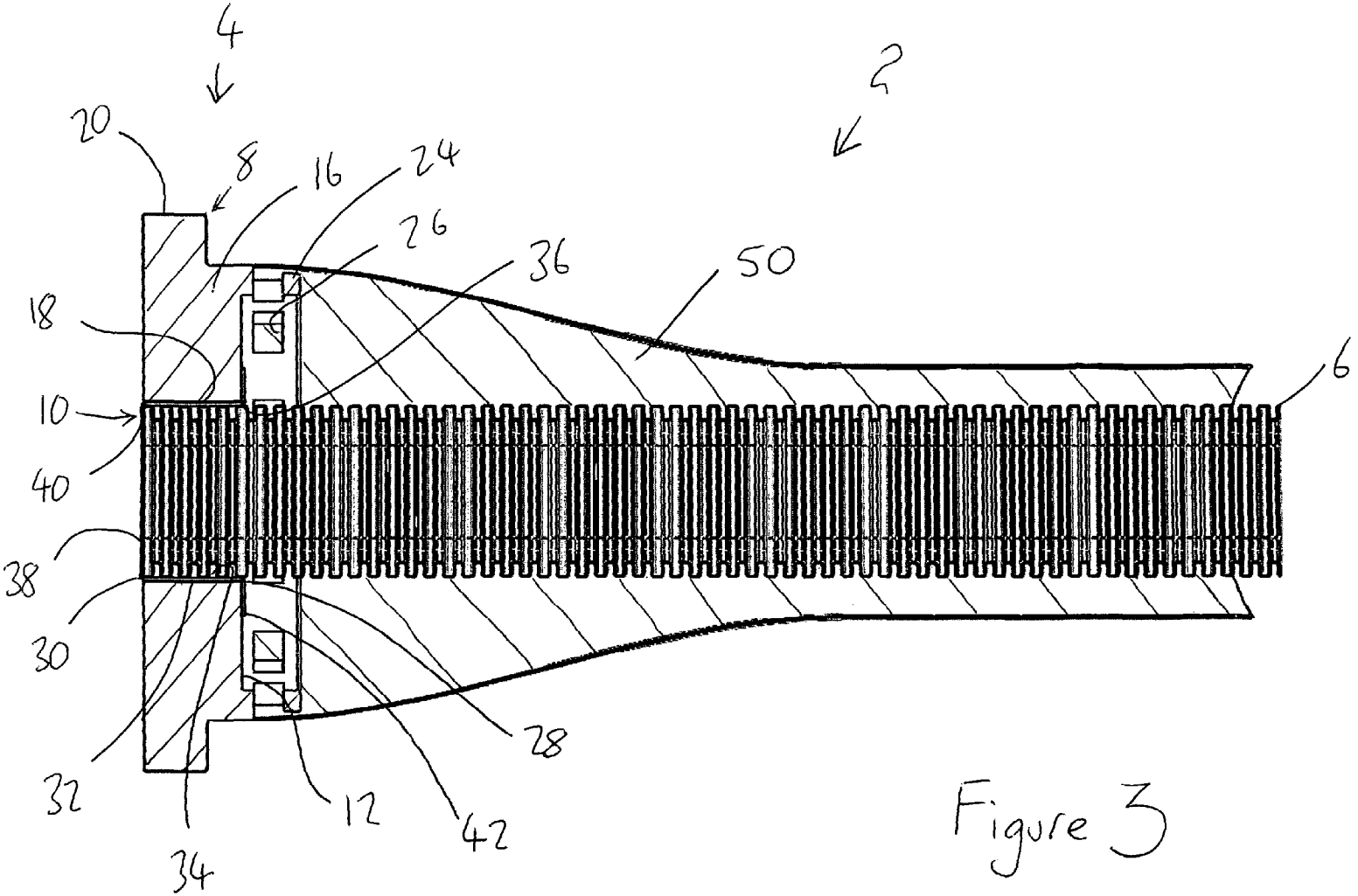
FIG. 3 is a cross-sectional view of the assembly of FIG. 2 in a second assembled condition.

As shown in FIG. 3, a flexible sleeve 50 is formed from silicone rubber and is cast about the outer surface of the waveguide 6 and the cylindrical ring 24 of the flange assembly. The sleeve material extends through the openings 26 in the ring 24 and forms an interference connection with the flange assembly 8.

Figure 4:
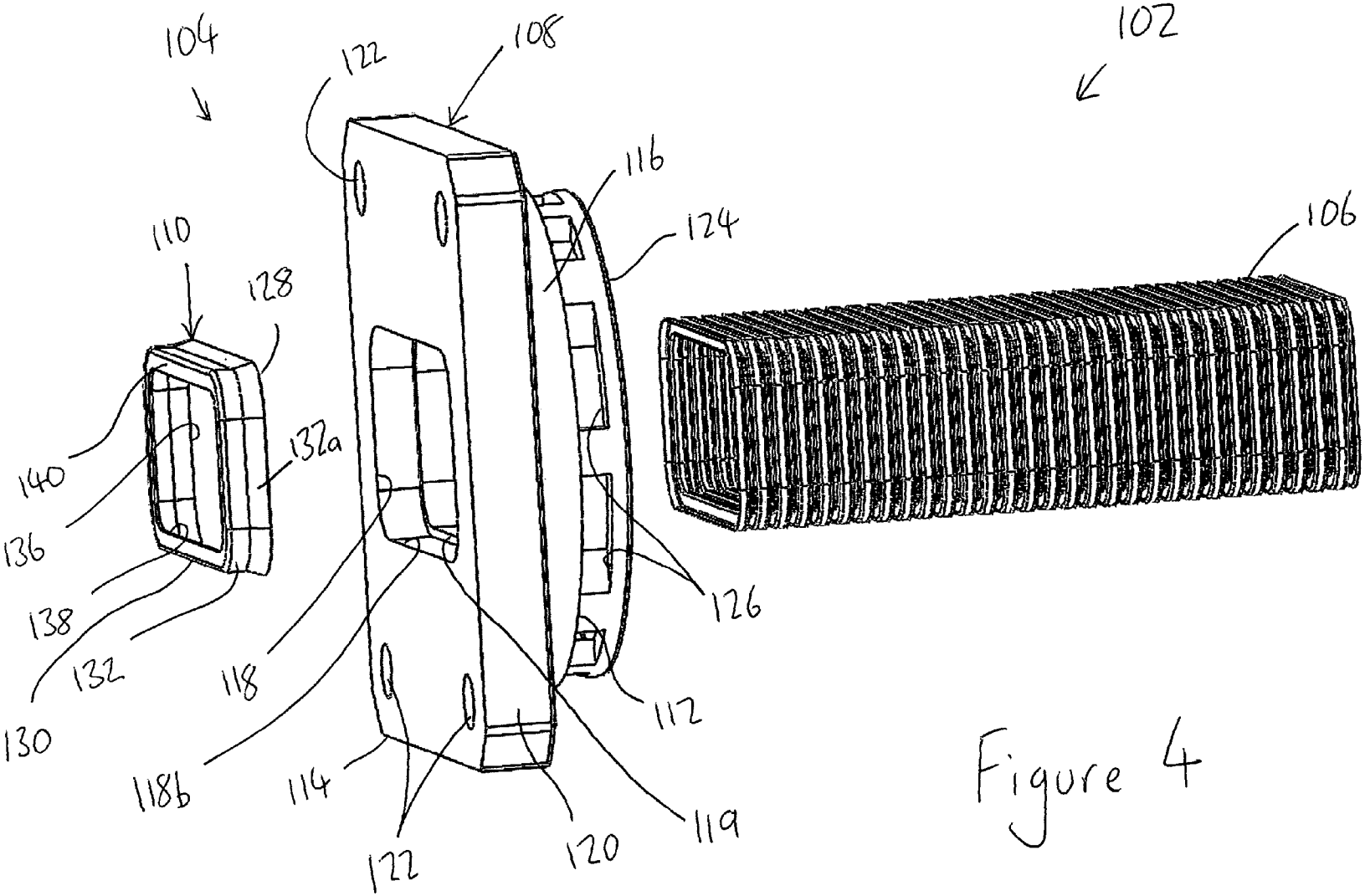
FIG. 4 is a an exploded perspective view of a waveguide assembly comprising a waveguide adapter assembly according to a second embodiment of the present invention.
Figure 5:
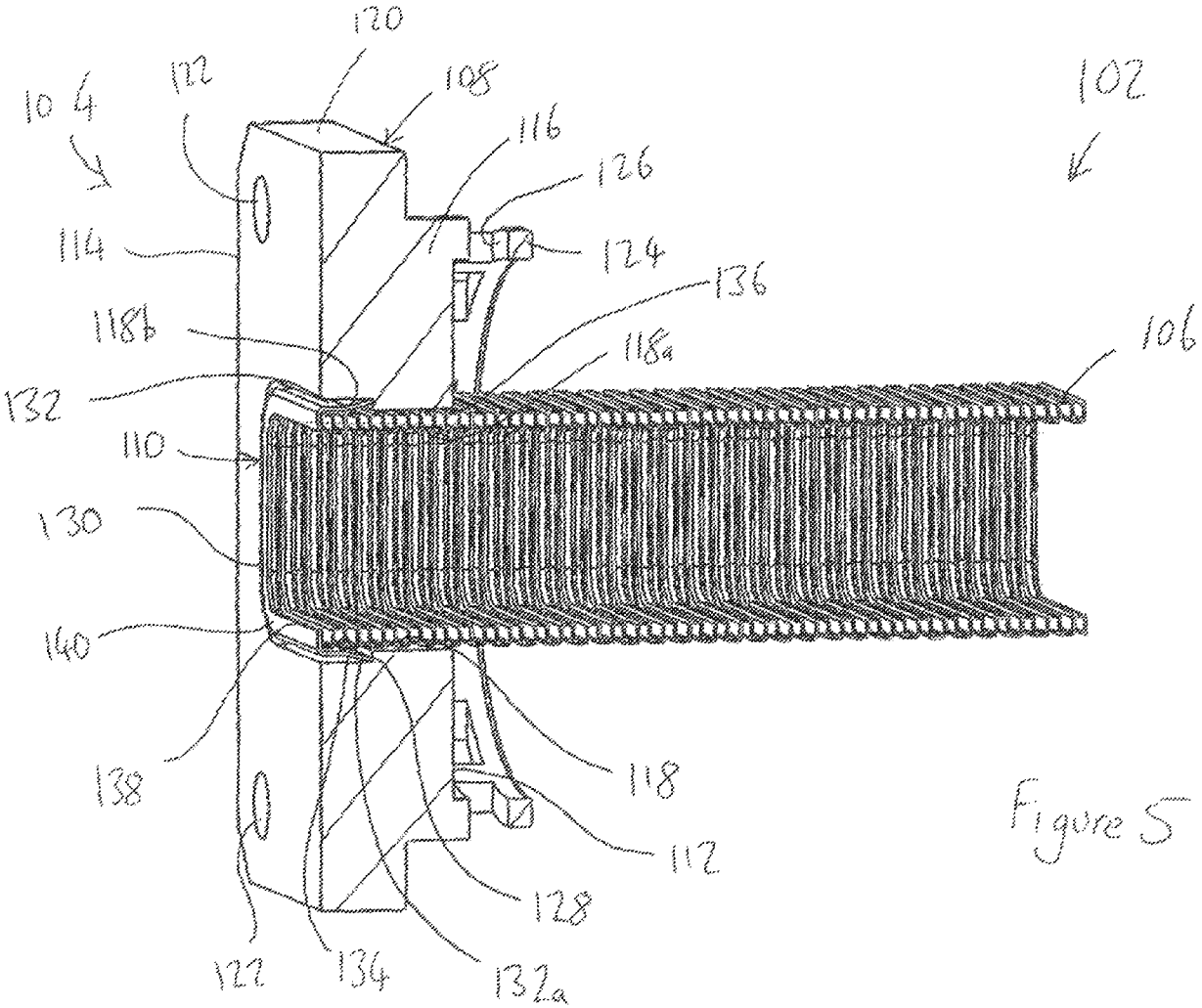
FIG. 5 is a cross-sectional view of the assembly of FIG. 3 in a first assembled condition.
Figure 6:
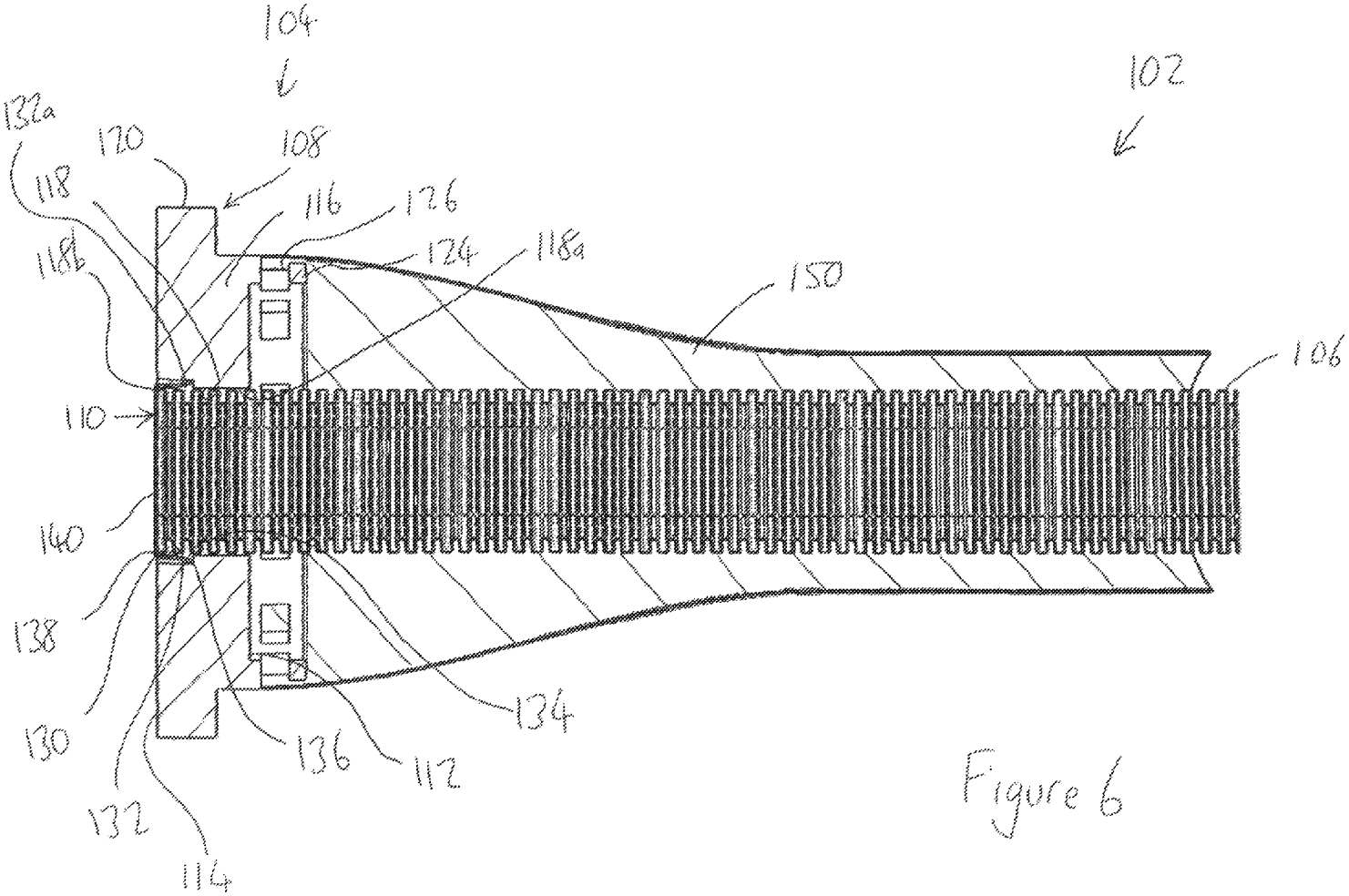
FIG. 6 is a cross-sectional view of the assembly of FIG. 5 in a second assembly condition.

Turning to FIGS. 4 to 6, there is shown a second embodiment of a waveguide assembly according to the present invention. Referring to FIG. 4, the waveguide assembly, generally indicated as 102, comprises a waveguide adapter assembly, generally indicated as 104, and a waveguide 106 of the same known configuration as shown in FIG. 1. The waveguide adapter assembly 104 comprises a flange assembly 108 and an adapter 110.

The flange assembly 108 has a first end 112 for receiving the waveguide 106 and a second end 114 for connecting with an apparatus. The flange assembly 108 is of a molded plastic material, in particular NYLON (an aliphatic or semi-aromatic polyamide).

The flange assembly 108 comprises a flange body 116 having a generally rectangular bore 118 extending longitudinally therethrough. A generally rectangular flange 120 is provided at the second end 114 of the flange assembly. The flange 120 is provided with bores 122 therethrough for receiving bolts (not shown for clarity) for connecting the flange 120 to the apparatus.

Referring to FIG. 5, the bore 118 is provided with a first portion 118*a* extending from the first end 112 of the flange assembly and a second portion 118*b* extending from the second end 114 of the flange assembly 108. The first bore portion 118*a* has a cross-sectional area less than that of the second bore portion 118*b*, thereby forming a shoulder 119 within the bore, visible in FIG. 4.

A cylindrical ring 124 extends from flange body 116 at the first end 112 of the flange assembly and is provided with rectangular openings 126 therein.

Turning to the adapter 110, the adapter has a first end 128 and a second end 130. The adapter 110 further has an adapter body 132 having a cavity 134 therein having a first opening 136 in the first end 128 and a second opening 138 in the second end 130. The cavity 134 is generally rectangular in cross-section. A waveguide retaining flange 140 extends into the cavity within the adapter body from the second end 130.

The adapter body 132 has a first end portion 132*a* and is elastically deformable. When assembled, the first end portion 132*a* abuts the shoulder 119 (FIG. 4) in the bore 118 in the flange assembly, as shown in FIG. 5. In use, the action of securing the flange 120 to the apparatus forces the first end portion 132*a* of the adapter body 132 against the shoulder 119, deforming the adapter body. The elastic properties of the adapter body 132 urge the second end 130 into better contact with the corresponding surface of the apparatus.

The adapter 110 is preferably formed from brass. Other suitable materials include aluminium, copper, and non-conductive materials, such as a polymer, coated in a layer of an electrically conductive material.

The components of the waveguide assembly 102 are assembled as shown in FIG. 5, that is with the end portion of the waveguide 106 extending through the first opening 136 and received within the cavity 134 of the adapter body 132. The end of the waveguide 106 is soldered to the waveguide retaining flange 140. The adapter 110 is received in the second bore portion 118*b* in the body 116 of the flange assembly 108 with its first end 128 abutting the shoulder 119 within the bore 118.

As shown in FIG. 6, a flexible sleeve 150 is preferably formed from silicone rubber, or another synthetic rubber, such as neoprene, and is cast about the outer surface of the waveguide 106 and the cylindrical ring 124 of the flange assembly. The sleeve material extends through the openings 126 in the ring 124 and forms an interference connection with the flange assembly 108.

The invention claimed is:

1. A waveguide assembly for coupling a waveguide to an apparatus, the assembly comprising:

a waveguide;

a waveguide adapter assembly, the adapter assembly comprising: an adapter body receiving an end portion of the waveguide, the adapter body being formed from an electrically conductive material, the adapter body having a first end and a second end, the adapter body further having a cavity therein, the cavity having a first opening in the first end for receiving the end portion of the waveguide and a second opening in the second end for communicating with a corresponding opening in the apparatus, the second end having a mating face around the second opening for mating with a corresponding surface of the apparatus;

wherein the end portion of the waveguide is attached to the adapter body; and a flange assembly having a first end, and a second end for connecting to the apparatus, the flange assembly having a bore therethrough;

wherein the adapter body is received in the bore in the flange assembly at the second end of the flange assembly and the waveguide is received in the bore in the flange assembly;

wherein the flange assembly is formed from an electrically non-conductive material.

2. The waveguide adapter assembly according to claim 1, wherein the flange assembly comprises an outer surface, the outer surface of the flange assembly comprising one or more openings, recesses or protrusions at the first end of the flange assembly.

3. The waveguide adapter assembly according to claim 1, wherein the adaptor body extends through the flange assembly from the first end thereof to the second end thereof.

4. The waveguide adapter assembly according to claim 3, wherein the adaptor body is provided with a flange at the first end thereof in contact with the first end of the flange assembly.

5. The waveguide adapter assembly according to claim 1, wherein the bore through the flange assembly has a portion at the second end of the flange assembly having an increased cross-sectional dimension.

6. The waveguide adapter assembly according to claim 5, wherein the bore in flange assembly comprises a shoulder formed by the said portion.

7. The waveguide adapter assembly according to claim 5, wherein the adaptor body extends partially through the bore in the flange assembly from the second end of the flange assembly within the portion of increased cross-sectional dimension.

8. The waveguide adapter assembly according to claim 1, wherein the cavity in the adapter body is provided with a flange against which the end portion of the waveguide can abut.

9. The waveguide adapter assembly according to claim 8, wherein the flange is provided at the opening in the second end of the adapter body.

10. The waveguide adapter assembly according to claim 9, wherein the flange extends wholly around the circumference of the second opening in the second end of the adapter body.

11. The waveguide adapter assembly according to claim 9, wherein the flange is flush with the mating face of the second end of the adapter body.

12. The waveguide adapter assembly according to claim 1, wherein the flange assembly is provided with means to form an interference connection with a sleeve cast around the flange assembly.

13. The waveguide adapter assembly according to claim 12, wherein said means to form an interference connection with a sleeve cast around the flange assembly comprises a protrusion extending from the first end of the flange assembly.

14. The waveguide adapter assembly according to claim 13, wherein the protrusion is provided with one or more openings therein.

15. The waveguide adapter assembly according to claim 14, wherein the flange assembly comprises an outer surface, and wherein the outer surface of the flange assembly is provided with an opening therein, the adapter body comprising an opening aligning with the opening in the flange assembly.

16. The waveguide adapter assembly according to claim 13, wherein the protrusion comprises a ring extending from the first end of the flange assembly.

17. The waveguide adapter assembly according to claim 1, wherein the adapter body is of a metal alloy.

18. The waveguide assembly according to claim 1, the flange assembly comprises an outer surface and the waveguide comprises an outer surface, the assembly further comprising a flexible sleeve extending over at least a portion of the outer surface of the waveguide and a portion of the outer surface of the flange assembly.

* * * * *